US008001631B2

(12) United States Patent
Giesser

(10) Patent No.: US 8,001,631 B2
(45) Date of Patent: Aug. 23, 2011

(54) RAIL FOR HOSPITAL BED

(75) Inventor: Peter Giesser, Marrickville (AU)

(73) Assignee: Medicraft Australia Pty Limited, Marrickville, New South Wales (AU)

( * ) Notice: Subject to any disclaimer, the term of this patent is extended or adjusted under 35 U.S.C. 154(b) by 222 days.

(21) Appl. No.: 11/502,741

(22) Filed: Aug. 11, 2006

(65) Prior Publication Data

US 2008/0010745 A1 Jan. 17, 2008

(30) Foreign Application Priority Data

Aug. 11, 2005 (AU) ..... 2005203585

(51) Int. Cl.
*A47C 21/08* (2006.01)
*A47D 7/00* (2006.01)

(52) U.S. Cl. ..... 5/430; 5/425; 5/428

(58) Field of Classification Search ..... 5/430, 428, 5/425, 100
See application file for complete search history.

(56) References Cited

U.S. PATENT DOCUMENTS 1,043,701 A * 11/1912 Hornsey ..... 5/100
1,900,478 A * 3/1933 Zimmermann ..... 5/100
3,055,020 A * 9/1962 Mann ..... 5/430
3,093,839 A * 6/1963 Higgins ..... 5/429
3,336,609 A * 8/1967 Taylor ..... 5/430
3,419,922 A * 1/1969 Malherbe ..... 5/430
3,526,008 A * 9/1970 Pruim ..... 5/430
3,840,917 A * 10/1974 Taylor ..... 5/430
4,103,376 A * 8/1978 Benoit et al. ..... 5/430
4,509,217 A * 4/1985 Therrien ..... 5/430
4,653,129 A * 3/1987 Kuck et al. ..... 5/430
4,724,559 A * 2/1988 Bly et al. ..... 5/425
4,811,436 A * 3/1989 Schwartz ..... 5/93.1
5,745,936 A * 5/1998 Van McCutchen et al. ..... 5/600
5,784,732 A * 7/1998 Vail ..... 5/430
6,446,283 B1 * 9/2002 Heimbrock et al. ..... 5/425
6,564,404 B1 * 5/2003 Nanahara ..... 5/430
6,691,345 B2 * 2/2004 Nanahara ..... 5/430
7,039,971 B2 * 5/2006 Sebastien ..... 5/662
2003/0106151 A1 * 6/2003 Nanahara ..... 5/430
2005/0144720 A1 * 7/2005 Poulin et al. ..... 5/425

FOREIGN PATENT DOCUMENTS

GB 2130083 A * 5/1984
GB 2155778 A * 10/1985

* cited by examiner

*Primary Examiner* — Robert G Santos
*Assistant Examiner* — Alyson M Merlino
(74) *Attorney, Agent, or Firm* — Barnes & Thornburg LLP

(57) ABSTRACT

A rail assembly (10) for a hospital bed (11). The rail assembly (10) includes a based (13) having brackets (14) that provide for pivoting movement of horizontally extending runs (17) between a lowered position providing access to the bed (11), and a raised position maintaining a patient on the bed.

12 Claims, 5 Drawing Sheets

RAIL FOR HOSPITAL BED

TECHNICAL FIELD

The present invention relates to side rails for beds and more particularly but not exclusively to side rails for hospital beds.

BACKGROUND OF THE INVENTION

Hospital beds are typically provided with a rail assembly on at least one longitudinal side, if not both longitudinal sides. The rail assemblies are provided to ensure the patient does not accidentally fall from the bed. At least one of the rail assemblies needs to be movable from a raised position to a lowered position so that the patient may leave the bed.

A disadvantage of the above discussed rail assemblies is that in the raised position they inhibit health professionals caring for the patient, while in the lowered position do not aide in retaining the patient in the bed when caring for the patient.

OBJECT OF THE INVENTION

It is the object of the present invention to overcome or substantially ameliorate the above disadvantages.

SUMMARY OF THE INVENTION

There is disclosed herein a rail assembly for a bed, said assembly including:

at least one elongated rail member having longitudinally opposite first and second end portions;

a first pivot assembly attached to said member and to pivotally attach the rail member to a bed;

a second pivot assembly attached to said member at a position spaced from said first assembly and to pivotally attach said member to said bed;

and wherein the pivot assemblies are configured so that said rail member is movable between a lowered position and a raised position relative to the bed; and said rail assembly further including a securing device selectively operable to retain the rail member in an intermediate position between said raised position and said lowered position.

Preferably, said rail assembly includes:

a base to be fixed to the bed with said pivot assemblies pivotally attaching the rail member to the base.

Preferably, said first pivot assembly includes:

a first end rail member pivotally attached to the base and pivotally attached to a first end portion of said member so that said first end rail member pivots relative to said base about a generally horizontal axis and relative to said rail member about a generally horizontal axis;

and said second pivot assembly includes:

a second end rail member, said second end rail member being pivotally attached to a second end portion of said member for pivoting movement relative thereto about a generally horizontal axis, and pivotally attached to said base for pivoting movement relative thereto about a generally horizontal axis.

Preferably, said securing device includes a plate attached to said base, said plate having an aperture, and a movable securing member attached to one of said end rail members so as to be movable therewith and selectively engageable with said aperture to retain the rail member in the intermediate position.

Preferably, said plate has three apertures, the apertures corresponding to the raised position, the lowered position and the intermediate position of the rail member, with said securing member being selectively engageable with one of the apertures to locate the elongated rail member in a selected one of the positions.

Preferably, said plate is a first plate, and said securing device includes a second plate to which said movable securing member is attached, said second plate covering said apertures.

Preferably, said first plate includes a slot, and there is attached to said second plate a stop member moved along said slot to engage opposite ends thereof to locate the rail assembly in the raised position or the lowered position, with said second plate covering said slot.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
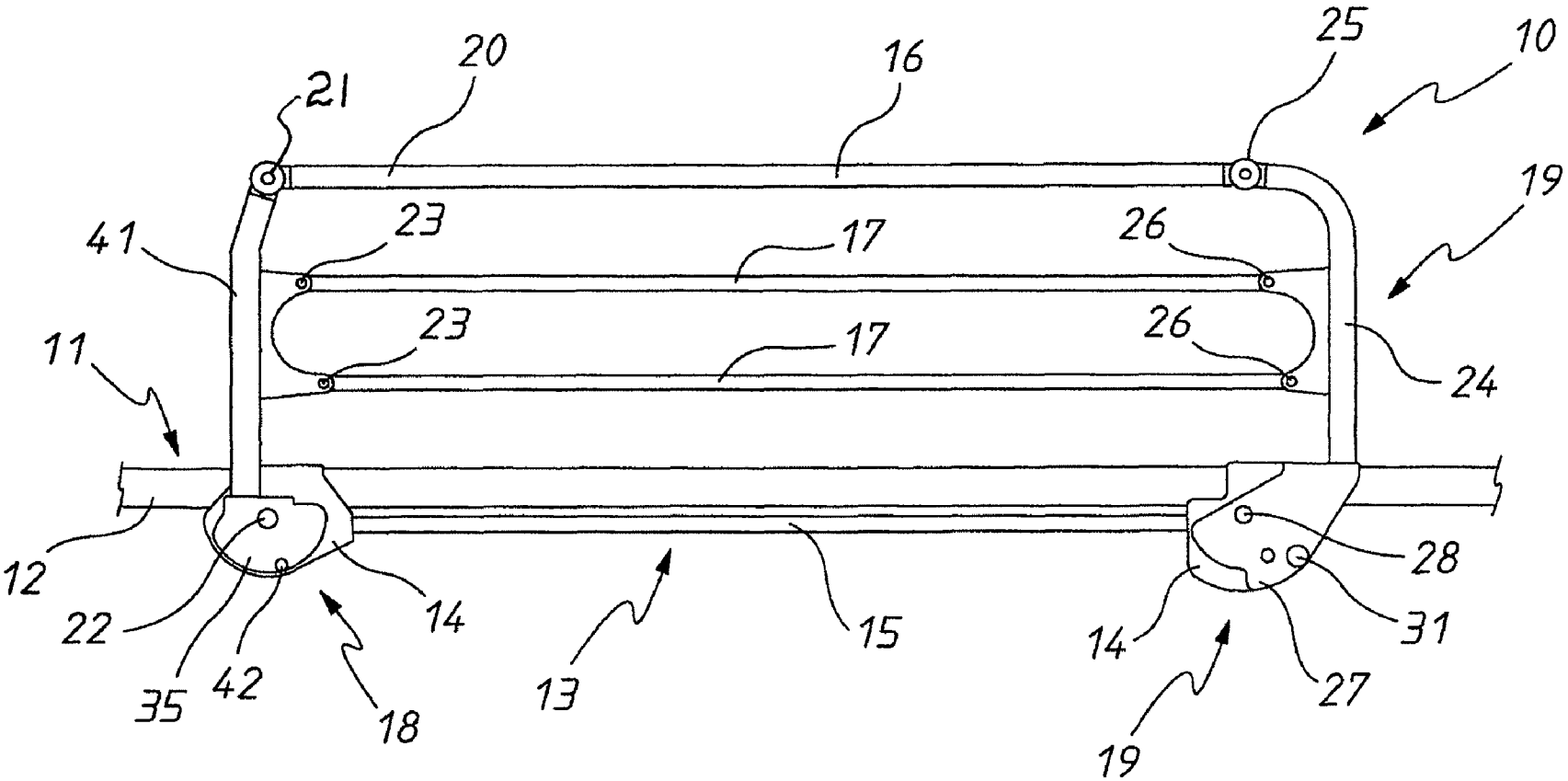
FIG. 1 is a schematic side elevation of a hospital bed rail assembly in a raised position.

In the accompanying drawings there is schematically depicted a side rail assembly 10 for a hospital bed 11. The hospital bed 11 has a side beam 12 to which the assembly 10 is attached.

The rail assembly 10 includes a base 13 having brackets (plates) 14 that are attached to the side beam 12 so as to be fixed thereto. The brackets 14 are joined by an elongated brace 15.

The rail assembly 10 includes an upper elongated rail member 16 that is generally horizontally extending, and a series of elongated generally horizontally extending rungs 17. Attaching the elongated rail member 16 and rungs 17 to the base 13 are pivot assemblies 18 and 19.

The pivot assembly 18 includes an end rail member 41 that is pivotally attached to an end portion 20 of the member 16 by means of a pivot 21. The pivot 21 provides a generally horizontal pivot axis about which the members 16 and 41 move angularly relative to each other. The member 41 is also attached to one of the brackets 14 by means of a plate 35 having a pivot 22. The member 41 is fixed to the plate 35. The pivot 22 provides a generally horizontal pivot axis 55 about which the member 19 pivots relative to the base 13. The axis 55 is transverse of the bed 11.

The rungs 17 are each attached to the member 19 by a pivot 23, again the pivots 23 each providing a generally horizontal pivot axis.

The pivot assembly 19 also includes an end rail member 24 that is attached to the member 16 by means of a pivot 25. The pivot 25 again provides a generally horizontal pivot axis about which the members 16 and 24 move angularly relative to each other. The rungs 17 are also attached to the member 24 by pivots 26, again providing generally horizontal pivot axes.

The second pivot assembly 19 further includes a plate 27 that is pivotally attached to the bracket 14 by means of a pivot 28. The pivot 28 providing a generally horizontal pivot axis 56 about which the member 24 angularly moves relative to the base 13. The axis 56 is generally parallel to the axis 55.

Figure 2:
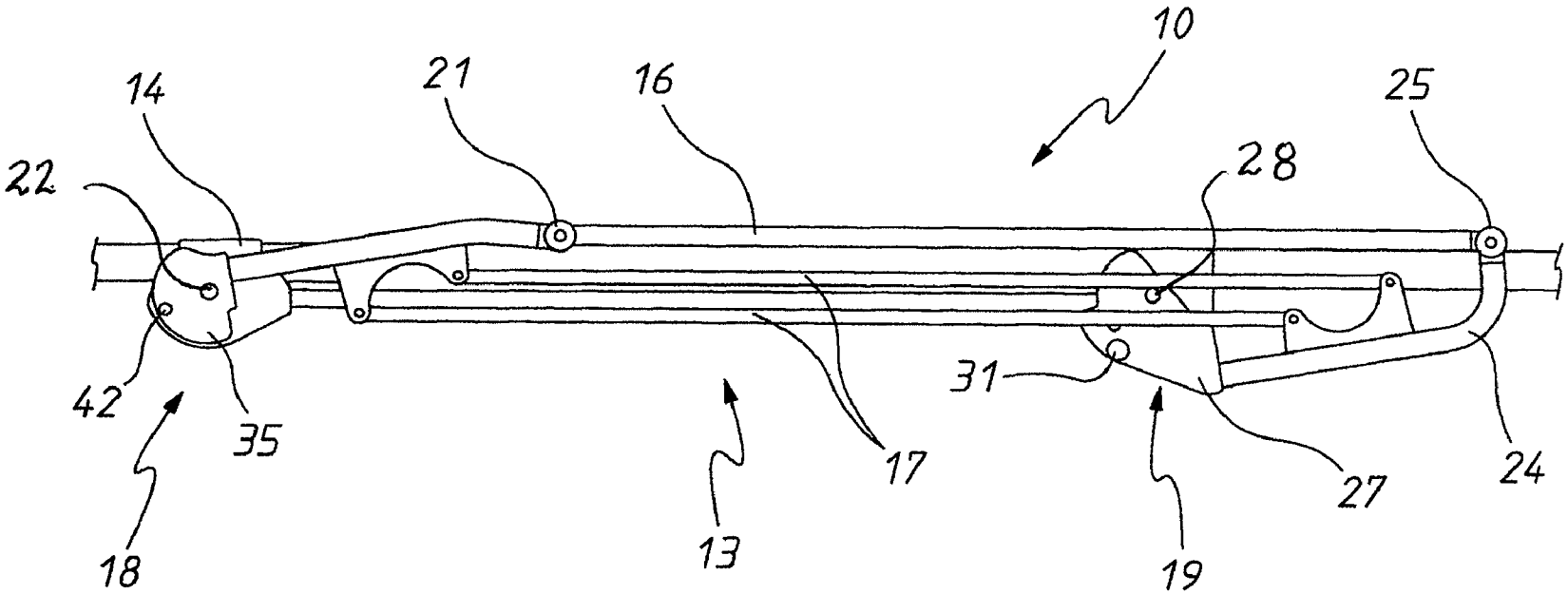
FIG. 2 is a schematic side elevation of the rail assembly of FIG. 1 in a lowered position.
Figure 3:
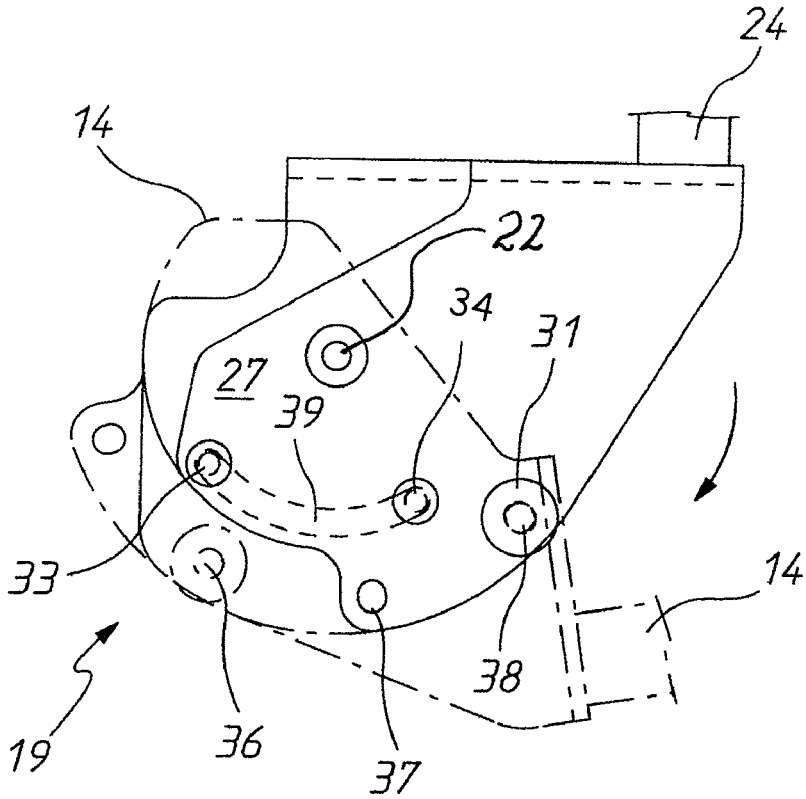
FIG. 3 is a schematic side elevation of a catch device employed in the assembly of FIGS. 1 and 2.
Figure 4:
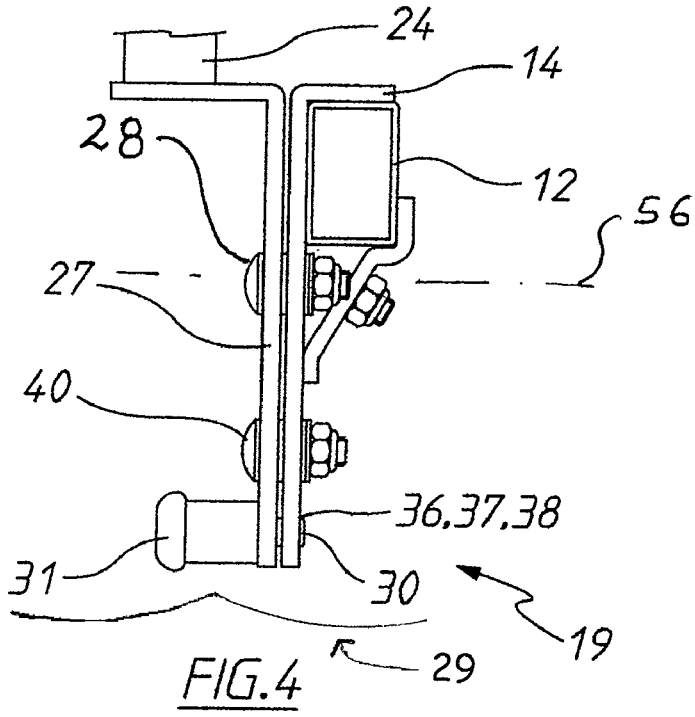
FIG. 4 is a schematic end elevation of the catch device of FIG. 3.
Figure 5:
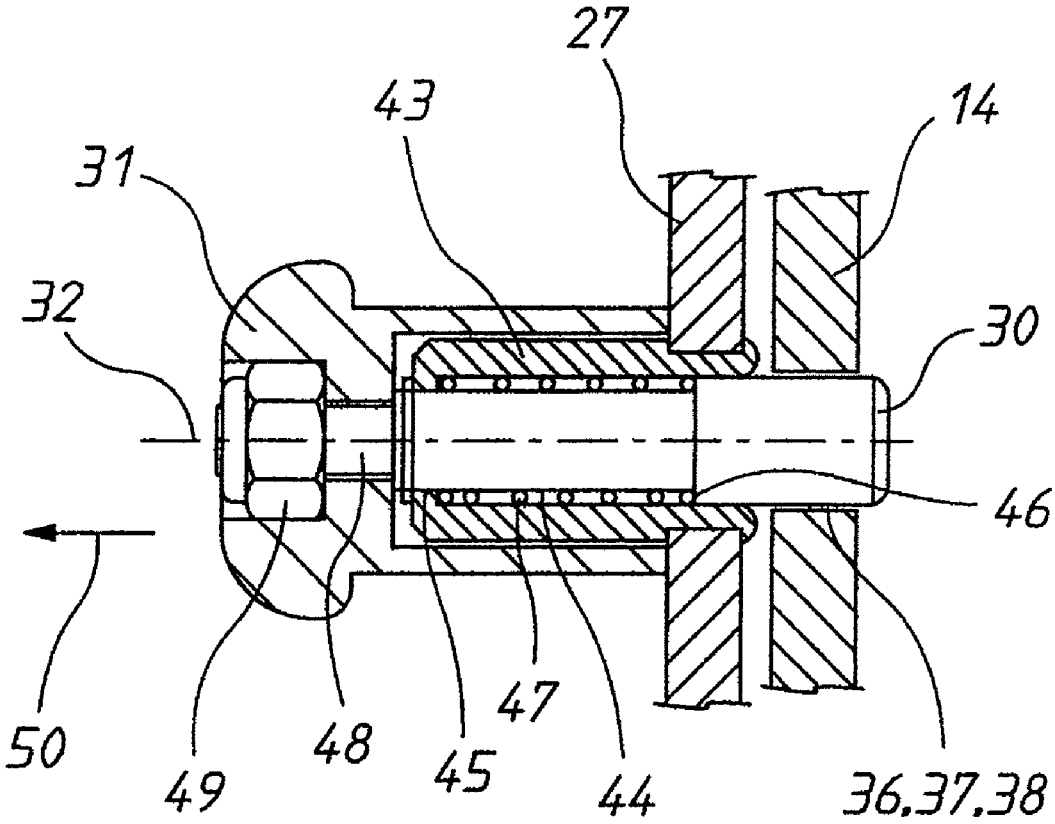
FIG. 5 is a schematic sectioned side elevation of the catch device of FIGS. 3 and 4.
Figure 6:
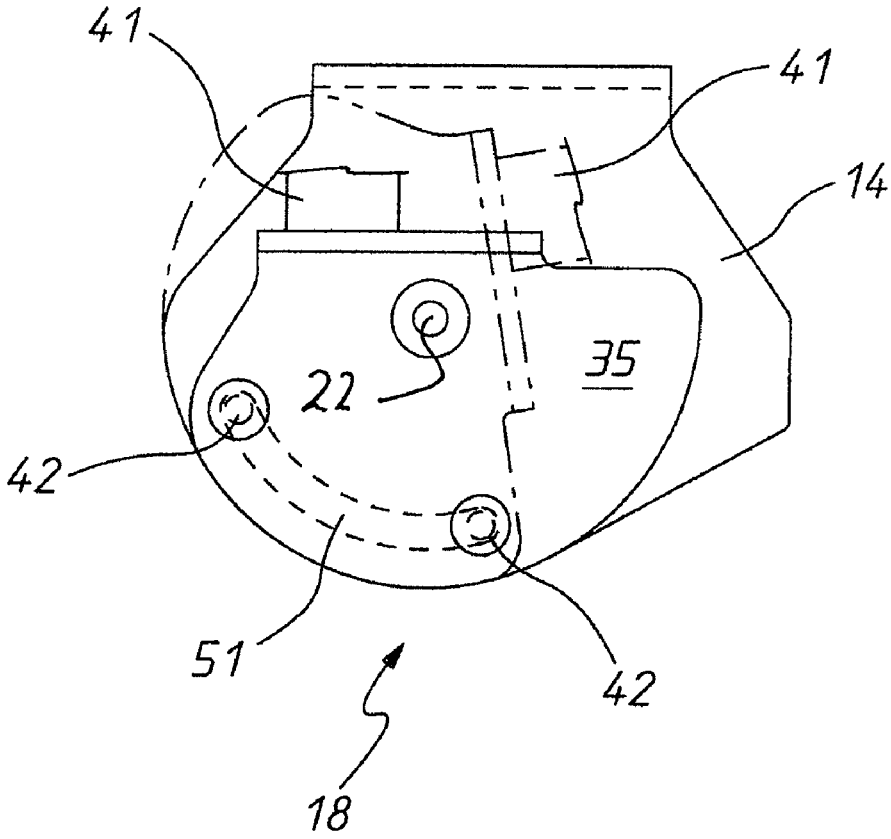
FIG. 6 is a schematic side elevation of a pivot assembly employed in the rail assembly of FIG. 1.
Figure 7:
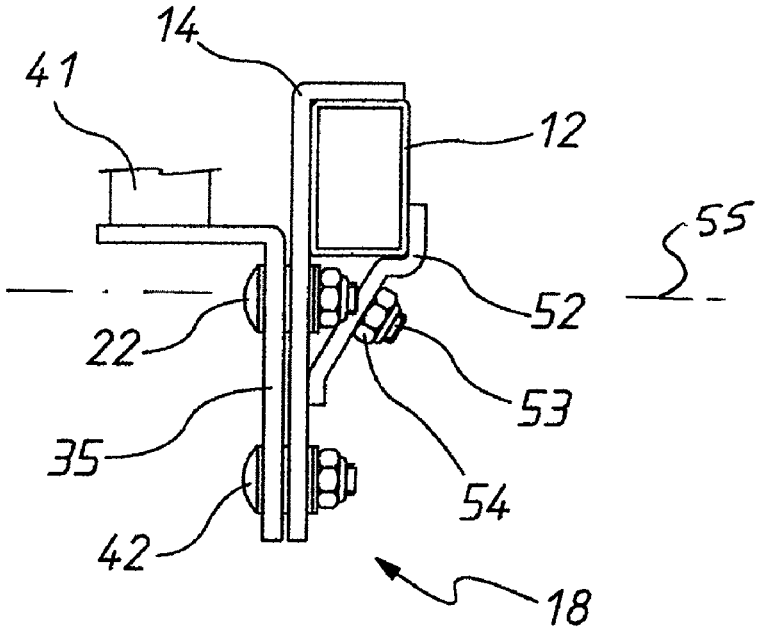
FIG. 7 is a schematic part sectioned end elevation of the pivot assembly of FIG. 6.

The plate 27 has attached to it a securing device 29 that includes a shaft 30 having a knob 31. The knob 31 is moved longitudinally of the axis 32 so that the shaft 30 can engage a respective one of the apertures 36, 37 or 38 formed in the bracket 14. When the shaft 30 is engaged with the aperture 36, the rail assembly 10 is maintained in the raised position as shown in FIG. 1. When the shaft 30 is engaged with the aperture 37, the rail assembly 10 is in an intermediate position between the position shown in FIGS. 1 and 2. When the shaft is engaged with the aperture 38, the rail assembly 10 is in the lowered position as shown in FIG. 2.

The bracket 14 includes a slot 39 that extends angularly about the pivot 28, the slot 39 having opposite ends 33 and 34. Attached to the plate 27 is a projection 40 that slides along the slot 39 and engages the end portions 33 and 34 to locate the rail assembly 10 in the raised and lowered positions. Essentially the projection 39 acts as a stop in respect of the travel limits of the plate 27 relative to the bracket 14. Preferably, the bracket 14 of the pivot assembly 18 is a plate having a slot 51 extending angularly about the pivot 22, and the plate 35 includes a stop 42 that engages the slot 51 of the plate 14 again to act as a stop mechanism to define the raised and lowered positions.

When the rail assembly 10 is fixed to the bed 11, the plate 27 covers the apertures 36, 37 and 38 as well as the slot 39 to thereby inhibit injury. The apertures 36, 37 and 38 and slot 39 are covered irrespective of the position of the plate 27 relative to the bracket 14. In respect of the pivot assembly 18, again the plate 35 covers the slot in the bracket 14, again irrespective of the position of the plate 35.

The end rail members 24 and 41, brace 15 and elongated rail member 16 forms a parallelogram.

As mentioned previously, the shaft 30 is urged into engagement in a selected one of the apertures 36, 37 or 38. In particular a knob base 43 is fixed to the plate 27. The base 43 is hollow so as to provide a passage 44. The passage 44 terminates at one end with an annular flange 45. Compressed between the flange 45 and an annular surface 46 of the shaft 30 is a spring 47. Accordingly the spring 47 urges the shaft 32 into engagement with a selected one of the apertures 36, 37 or 38. The knob 31 is attached to shaft by means of a threaded extension 48 and a nut 49. When the knob 31 is pulled in the direction of the arrow 50, the shaft 30 is removed from the aperture 36, 37 or 38 thereby permitting movement of the plate 27 and therefore movement of the rail assembly 10 between the positions thereof.

In respect of the pivot assemblies 18 and 19, each includes a clamp plate 52 and a bolt 53, with a bolt 53 being secured to the bracket 14. A nut 54 tensions the bolt 53 so that the clamp plate 52 presses the bracket 14 against the side beam 12 so that the associated assembly 18 or 19 is fixed to the side beam 12.

In respect of the above described preferred embodiment, it should be appreciated the plates 27 and 35 cover the slots 39 and 51 as well as the apertures 36, 37 and 38, when the rail assembly 10 is secured to the bed 11. The above arrangement limits the probability of injury during operation of the rail assembly 10.

The invention claimed is:

1. A side rail assembly for a bed, said side rail assembly including:

at least one elongated side rail member having longitudinally opposite first and second end portions;

a first pivot assembly attached to said at least one elongated side rail member and being capable of pivotally attaching said at least one elongated side rail member to a bed for pivoting movement about a first generally horizontal pivot axis, the first pivot assembly including a first end rail member that is pivotable about the first generally horizontal pivot axis and that is pivotably coupled to the first end portion of the at least one elongated side rail member;

a second pivot assembly attached to said at least one elongated side rail member at a position spaced from said first assembly, and being capable of pivotally attaching said at least one elongated side rail member to said bed for pivoting movement about a second generally horizontal pivot axis, the second axis being generally parallel to the first axis, the second pivot assembly including a second end rail member that is pivotable about the second generally horizontal pivot axis and that is pivotably coupled to the second end portion of the at least one elongated side rail member;

wherein said pivot assemblies are configured so that said at least one elongated side rail member is movable between a lowered position and a raised position relative to the bed; and said side rail assembly further including a securing device selectively operable to retain the at least one elongated side rail member in an intermediate position between the raised position and the lowered position, said securing device including:

a first plate that has three apertures spaced angularly about the second generally horizontal pivot axis and that mounts to the bed to remain substantially stationary relative to the bed during movement of the at least one elongated side rail member between the raised and lowered positions, a second plate that is coupled to the second end rail member to pivot therewith about the second generally horizontal pivot axis and that overlays said first plate so as to cover said apertures, and a movable securing member mounted on said second plate and selectively engageable with respective ones of the apertures to retain said at least one elongated side rail member in the raised, lowered, and intermediate positions, wherein a distance between said at least one elongated side rail member and said first and second horizontal pivot axes decreases as said at least one elongated side rail member moves from the raised position to the lowered position, wherein said first plate includes an arcuate slot spaced from the three apertures, and there is attached to said second plate a stop member moved along said arcuate slot to engage opposite ends thereof to locate the at least one elongated member in the raised position or the lowered position, with said second plate covering said slot.

2. The side rail assembly of claim 1, further comprising a base configured to be fixed to the bed and the first and second end rail members being coupled to the base.

3. The side rail assembly of claim 1, wherein said arcuate slot is closer to the second generally horizontal pivot axis than are the three apertures.

4. The side rail assembly of claim 2, wherein the base comprises an elongated brace and a pair of brackets coupled to the elongated brace, the brackets being configured to mount to the bed.

5. The side rail assembly of claim 4, wherein a portion of one of the pair of brackets serves as the first plate of the securing assembly.

6. The side rail assembly of claim 4, wherein the at least one elongated side rail member is maintained in substantially parallel relation with the elongated brace as the at least one elongated side rail member moves between the raised and lowered positions.

7. The side rail assembly of claim 4, further comprising a rung that has a first end pivotably coupled to the first end rail member and that has a second end pivotably coupled to the second end rail member.

8. The side rail assembly of claim 7, wherein the rung is maintained in substantially parallel relation with the elongated brace and with the at least one elongated side rail member as the at least one elongated side rail member moves between the raised and lowered positions.

9. The side rail assembly of claim 7, wherein the rung is situated below the at least one elongated side rail member and above the brace when the at least one elongated side rail member is in the raised position and wherein the rung is situated below the at least one elongated side rail member and the brace when the at least one elongated side rail member is in the lowered position.

10. The side rail assembly of claim 1, wherein the movable securing member comprises a shaft having an end that is selectively received in respective ones of the apertures to retain said at least one elongated side rail member in the raised, lowered, and intermediate positions.

11. The side rail assembly of claim 10, further comprising a knob mounted to the shaft and configured to be pulled to withdraw the shaft from whichever of the three apertures the shaft is received.

12. The side rail assembly of claim 10, wherein the shaft is spring biased toward receipt in the three apertures.

* * * * *